US009679467B2

(12) United States Patent
Hibbs, Jr.

(10) Patent No.: US 9,679,467 B2
(45) Date of Patent: Jun. 13, 2017

(54) INSTANT ALERT NETWORK SYSTEM

(71) Applicant: Pathfinder Intelligence, Inc., Tyler, TX (US)

(72) Inventor: Billy E. Hibbs, Jr., Tyler, TX (US)

(73) Assignee: Pathfinder Intelligence, Inc., Tyler, TX (US)

( * ) Notice: Subject to any disclaimer, the term of this patent is extended or adjusted under 35 U.S.C. 154(b) by 160 days.

(21) Appl. No.: 14/251,314

(22) Filed: Apr. 11, 2014

(65) Prior Publication Data

US 2014/0306802 A1 Oct. 16, 2014

Related U.S. Application Data

(60) Provisional application No. 61/811,196, filed on Apr. 12, 2013.

(51) Int. Cl.
*G08B 27/00* (2006.01)

(52) U.S. Cl.
CPC ..... *G08B 27/006* (2013.01)

(58) Field of Classification Search
CPC ..... G08B 27/006; G08B 25/14; G08B 27/00; G06F 17/3087; G06Q 10/10; H04W 12/12; H04W 4/043; H04W 4/22; H04W 76/007
See application file for complete search history.

(56) References Cited

U.S. PATENT DOCUMENTS

| | | | | |
|---|---|---|---|---|
| 5,621,798 | A * | 4/1997 | Aucsmith | H04L 12/5895 340/7.27 |
| 6,002,748 | A | 12/1999 | Leichner | |
| 7,224,957 | B2 | 5/2007 | Spector | |
| 7,286,648 | B1 | 10/2007 | Chang et al. | |
| 8,050,281 | B2 | 11/2011 | Casey et al. | |
| 8,150,925 | B2 | 4/2012 | Zimmers et al. | |
| 8,384,549 | B2 | 2/2013 | Lemmon | |
| 8,396,447 | B2 | 3/2013 | Reich et al. | |
| 2003/0120805 | A1* | 6/2003 | Couts | H04L 12/5855 709/238 |
| 2003/0187570 | A1* | 10/2003 | Impson | G08G 1/096716 701/117 |
| 2004/0193617 | A1 | 9/2004 | Adler | |
| 2005/0148317 | A1* | 7/2005 | Amano | G08B 25/08 455/404.1 |
| 2005/0181775 | A1* | 8/2005 | Rideout, Jr. | G06Q 10/109 455/414.3 |
| 2007/0216535 | A1* | 9/2007 | Carrino | G06F 17/3087 340/573.1 |

(Continued)

*Primary Examiner* — Sisay Yacob
(74) *Attorney, Agent, or Firm* — Kirby B. Drake; Klemchuk LLP

(57) ABSTRACT

An instant alert network system may transform a mobile communication device, such as a smart phone, into a "panic button" whereby a user may instantly broadcast an alert or alarm to users forming a defined group to a threat or emergency situation as opposed to relying on a single person or entity to initiate the alert. An instant alert network system may permit users to become the perimeter defense through activation and distribution of alerts via various forms of electronic communication. This will dramatically reduce the amount of time that may be needed to inform users of an impending threat, and it may allow defensive countermeasures to be deployed in virtually real-time in order to reduce the threat and possibly save lives.

19 Claims, 21 Drawing Sheets

(56) References Cited

U.S. PATENT DOCUMENTS

| | | | | |
|---|---|---|---|---|
| 2008/0194236 | A1 | 8/2008 | Johns | |
| 2008/0284587 | A1* | 11/2008 | Saigh | H04M 1/72541 340/539.13 |
| 2009/0251312 | A1* | 10/2009 | Shelton | G08B 5/222 340/539.13 |
| 2010/0009651 | A1 | 1/2010 | Daly et al. | |
| 2010/0306322 | A1 | 12/2010 | Conahan | |
| 2011/0111728 | A1* | 5/2011 | Ferguson | H04M 1/72541 455/404.2 |
| 2012/0003952 | A1 | 1/2012 | Gabriel | |
| 2012/0092161 | A1 | 4/2012 | West | |
| 2012/0329420 | A1 | 12/2012 | Zotti et al. | |
| 2013/0035055 | A1 | 2/2013 | Kirchmeier et al. | |
| 2013/0052982 | A1* | 2/2013 | Rohde | H04W 4/22 455/404.1 |
| 2013/0346333 | A1* | 12/2013 | Hassler | G06Q 10/107 705/325 |

* cited by examiner

INSTANT ALERT NETWORK SYSTEM

CROSS REFERENCE TO RELATED APPLICATION

This application claims the benefit of U.S. Provisional Application No. 61/811,196 filed Apr. 12, 2013, entitled "Instant Alert Network System" which is incorporated herein by reference in its entirety.

FIELD OF THE DISCLOSURE

The present disclosure generally relates to an alerting system, and more particularly to an instant alert network system.

BACKGROUND

When a person or entity is faced with a security threat, such as a gunman entering a school classroom, it has been challenging, if not impossible, for the person or entity to react quickly and alert others that may be potentially affected by the threat in order to reduce the severity and applicability of the threat. Difficulties also arise related to scalability of an alert when large numbers of people need to be notified about an impending threat.

SUMMARY

Embodiments of the present disclosure may provide an instant alert network system that may transform a mobile device into a "panic button" whereby an authorized user may instantly alert, via various forms of electronic communication, users in a defined group to a threat. When an authorized user activates an instant alert network system according to embodiments of the present disclosure, a secure web-service may be called, and this may trigger the sending of notifications to all contacts comprising an affected group to warn them of an impending threat. The number of contacts comprising an affected group may be unlimited in number. An instant alert network system according to embodiments of the present disclosure may allow each authorized user to be empowered to broadcast an alert as the threat is arising as opposed to relying on a single person or entity to initiate the alert. This will dramatically reduce the amount of time that may be needed to inform the affected group of a security threat, and it may allow defensive countermeasures to be deployed almost in real-time in order to reduce the threat and possibly save lives.

Embodiments of the present disclosure may provide a method for activating an instant alert network system, the method comprising using a communication device, contacting a secure web service over a wireless communication network to access a contact database housed on one or more servers to obtain contact information, selecting one or more contacts within the contact database, the one or more contacts affected by a threat, and transmitting an alert of the threat to the one or more selected contacts, wherein each of the contacts within the contact database can transmit the alert of the threat to the one or more selected contacts. The one or more contacts may be assigned to a user-defined group within the contact database, and the alert of the threat may be transmitted to the one or more contacts within the user-defined group. The one or more contacts may be assigned to more than one user-defined group within the contact database, and the alert of the threat may be transmitted to the one or more contacts within at least one user-defined group. The method may further comprise transmitting location-based information associated with the threat to the one or more selected contacts. The location-based information associated with the threat may be transmitted in the same alert notifying the one or more selected contacts of the threat. The alert may be transmitted through at least one of the following transmittal methods: text message, e-mail message, and push notification. The alert may be selected from the group comprising: active shooter, police, fire, medical, weather, employer, all clear, evacuate, help needed, take shelter, soft lockdown, chemical spill, and biohazard.

Embodiments of the present disclosure also may provide an instant alert network system comprising a contact management module, wherein each contact included in the contact management module is associated with at least one communication method through which the contact receives instant alerts, a home group with which the contact is associated, from what groups the contact can send instant alerts, and to what groups the contact can send instant alerts, and an alert type selection module, wherein, using a communication device, an authorized user selects one or more contacts within the contact management module and an alert type from the alert type selection module to send an instant alert associated with the alert type to communication devices of the selected one or more contacts over a wireless communication network. Each contact included in the contact management module may include additional information selected from the following: contact name, contact email address, contact phone number, and an identification of whether the contact is an active user of the instant alert network system. The at least one communication method may be selected from the group comprising: email, voicemail, text message, and push notification. The instant alert may be selected from the group comprising: active shooter, police, fire, medical, weather, employer, all clear, evacuate, help needed, take shelter, soft lockdown, chemical spill, and biohazard. The selected one or more contacts may be in a geographical location associated with the threat. The selected one or more contacts may be affiliated with a single group within the contact management module. The selected one or more contacts may be affiliated with more than one group within the contact management module. The instant alert network system may further comprise a location-based tracking mechanism associated with the communication device of the authorized user, wherein the instant alert network system detects the location of the communication device of the authorized user and transmits the location information to the selected one or more contacts. The location-based tracking mechanism may be global positioning system (GPS). The alert type selection module may associate a message to be sent to the selected one or more contacts when a specific alert type is selected.

Other embodiments of the present disclosure may provide a method for transmitting an instant alert using a mobile communication device, the method comprising: accessing the instant alert system housed on one or more servers over a wireless communication network, selecting at least one group to receive an instant alert, the at least group selected from a secure contact management database housed on the one or more servers, selecting an alert type to be transmitted to the at least one group, the alert type associated with an emergency situation, and transmitting the selected alert type to the at least one group over the wireless communication network. The method may further comprise transmitting GPS coordinates associated with the mobile communication device transmitting the selected alert type to the at least one group. The selected alert type may be transmitted to the at least one group through one or more notification methods selected from the group comprising: email message, text message, voicemail message, and push notification.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide an instant alert network system, which may comprise a collection of smart phone and website applications that may transform a mobile communication device, such as a smart phone, into a "panic button" whereby a user may instantly alert an unlimited number of users in one or more defined groups to a security threat or other emergency situation, and the users may be alerted on their respective communication devices. Accordingly, each authorized user of the instant alert system may broadcast alarms or alerts instead of relying on a single person or entity to initiate an alert. The user also may send the location of his/her mobile communication device when alerting other users, and this may allow better pinpointing of where the threat or emergency situation has arisen. It should be appreciated that a threat may include but is not limited to a security threat, a weather emergency, a disaster emergency, and other emergency situations. In embodiments of the present disclosure, an instant alert network system may be used to initiate a nearly instantaneous lock down of a school, governmental entity, or any location having a high concentration of people in a matter of moments. An instant alert network system according to embodiments of the present disclosure may permit users to become the perimeter defense during a threat or emergency through activation and distribution of alerts via various forms of electronic communication, including but not limited to, text (SMS), e-mail and push notifications.

It should be appreciated that an unlimited number of contacts may be assigned to a group for notification purposes. The contacts associated with a group may be maintained within one or more secure databases that may be accessible via at least one tier of authentication to access the server-based system in which the one or more databases may operate. Authentication may be through SSL security protocols on data transmission over a wireless communication network according to an embodiment of the present disclosure. When an instant alert network system according to embodiments of the present disclosure is activated, a secure web-service may be called, and this may trigger the sending of electronic messages or notifications to all contacts or users identified in the relevant group to warn them of a pending security threat. An instant alert network system according to embodiments of the present disclosure may allow each authorized user to broadcast an alert or alarm as opposed to relying on a single person or entity to initiate the alert. This will dramatically reduce the amount of time that may be needed to inform users of a threat, and it may allow defensive countermeasures to be deployed in virtually real-time in order to reduce or otherwise address the threat and possibly save lives.

Figure 1:
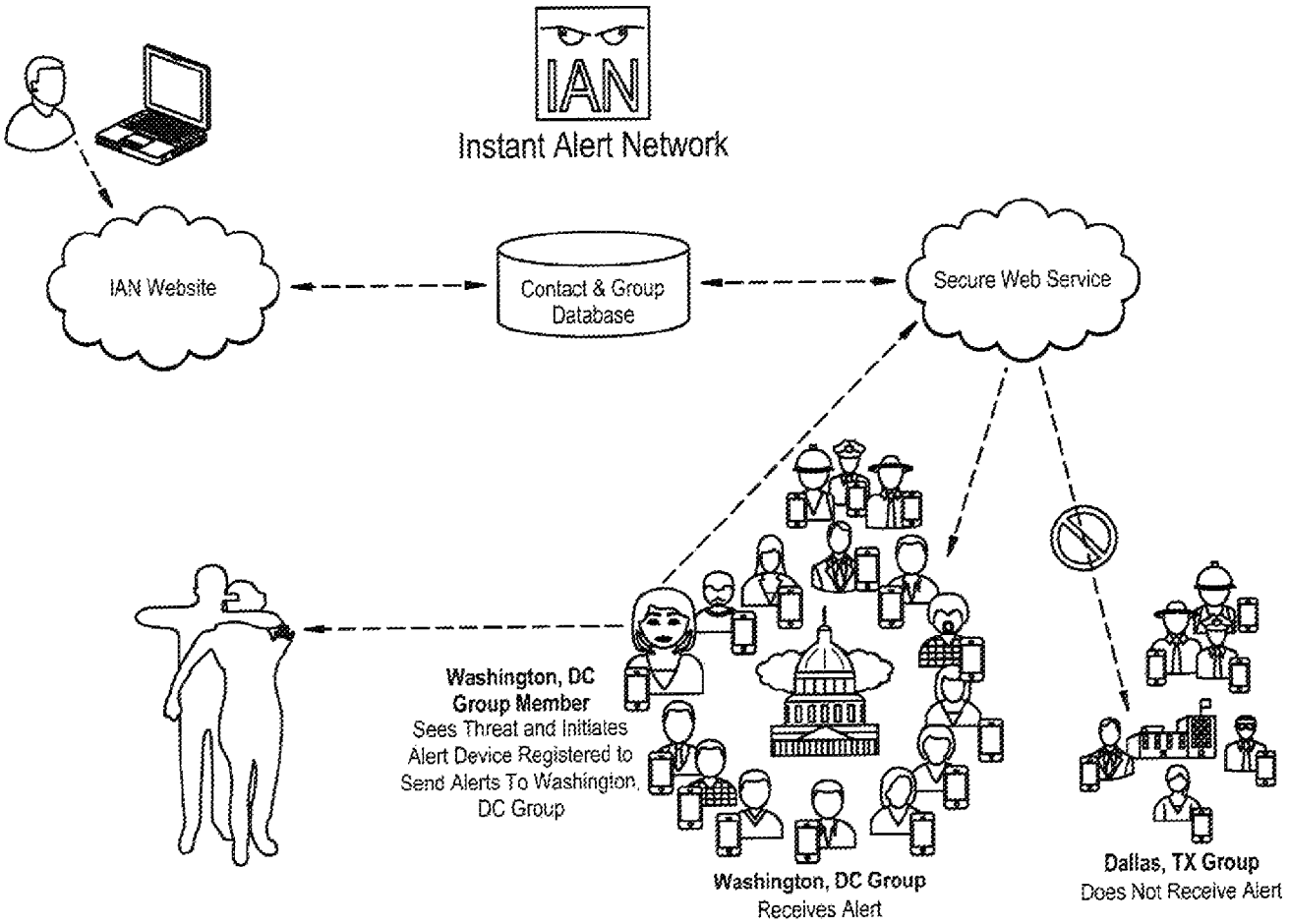
FIG. 1 depicts an instant alert network system according to an embodiment of the present disclosure.

FIG. 1 depicts an instant alert network system according to an embodiment of the present disclosure. In this embodiment, a user may access the instant alert network website in order to register to be part of the network. The instant alert network website may interact through a communication network, such as the Internet, with a contact and group database that may store the user's contact information as well as contact information for others within relevant groups of which the user may be a member. For example, the user may be a teacher at a school, and accordingly, the user would be associated with the school as one group for the purpose of receiving and/or transmitting alerts. The same user also may be the parent of a child attending another school, and accordingly, the user also may be associated with his/her child's school for the purpose of receiving alerts. The contact information for authorized users and alert recipients may be created and stored in one or more secure, cloud-based servers using a secure website application according to embodiments of the present disclosure.

As depicted in FIG. 1, the user may be a Washington, D.C. group member. He/she may see a threat and initiates an alert using his/her mobile device. The user's mobile phone may communicate with a secure web service that may access the contact and group database to obtain contact information for those that may be affected in the Washington, D.C. area. The secure web service may then transmit an alert to the Washington, D.C. group through their respective communication means identified in the contact and group database. As depicted in FIG. 1, since the alert is specific to the Washington D.C. area, it should be appreciated that even if the user is also a member of the Dallas, Tex. group, the Dallas, Tex. group would not receive the alert that originated with the user because the alert does not affect the user's contacts in the Dallas, Tex. area.

It also should be appreciated that contacts may be assigned to user-defined groups based on physical or geographical location and/or role within an organization according to some embodiments of the present disclosure. Each contact may be configured to send and receive alerts from more than one group according to embodiments of the present disclosure. When a contact is configured within the instant alert system, it should be appreciated that the configuration may include definitions as to how the communication device associated with the contact may receive notifications, including but not limited to SMS, e-mail, push notifications and combinations of the same.

In some embodiments of the present disclosure, an authorized user may be presented with one or more alert types from which to select. Alert types may be configured within an alert specifically targeted to at least one group associated with the authorized user. This flexibility may allow different groups to receive different alerts for the same alert type. In an embodiment of the present disclosure, up to six alert types may be configured to display on a contact's communication device. However, it should be appreciated that more or fewer alert types may be provided without departing from the present disclosure. The color of the icon associated with each alert type may be configured at the system level for each contact. When a contact initiates an alert on his/her communication device, a secure web-service may be called that may send SMS, e-mail, push notifications and combinations of the same to all contacts in the "send to" groups that may be configured for the authorized user.

While these alerts are being sent, an application communicating with the user's communication device may use the device's global positioning system (GPS) capabilities to ascertain the location where the alert was generated. Upon determining the location of the device, a second alert (via SMS, e-mail, push notification and combinations of the same) may be sent to all contacts in the "send to" groups, and this second message may contain a hyperlink to the map coordinates of the location from where the alert was first generated. In other embodiments of the present disclosure, in lieu of or in addition to a hyperlink, the message or alert may include a map depicting where the alert was generated, and the map may pinpoint where the recipient of the alert is located relative to where the alert was generated without departing from the present disclosure. In further embodiments of the present disclosure, the system may simultaneously or in real-time determine the location of device, and in such embodiments, a single alert may be sent identifying the type of alert as well as the map coordinates of the location where the alert was generated. It should be appreciated that the location-based tracking associated with the instant alert system may vary depending on the capabilities of the user's communication device.

In some embodiments of the present disclosure, location-based tracking and notification may allow the instant alert system to track the movement of the security threat or emergency situation. For example, if there is an active shooter in the building, users of the instant alert system may send alerts containing location-based information so that the active shooter may be tracked as he/she moves down a hall. In some embodiments of the present disclosure, a beacon system may be installed within a building that may facilitate location-based tracking through the instant alert system. Similarly, if there is a tornado in the area, users of the instant alert system may send alerts containing location-based information so that the tornado may be tracked as it moves through a geographical area.

Figure 2:
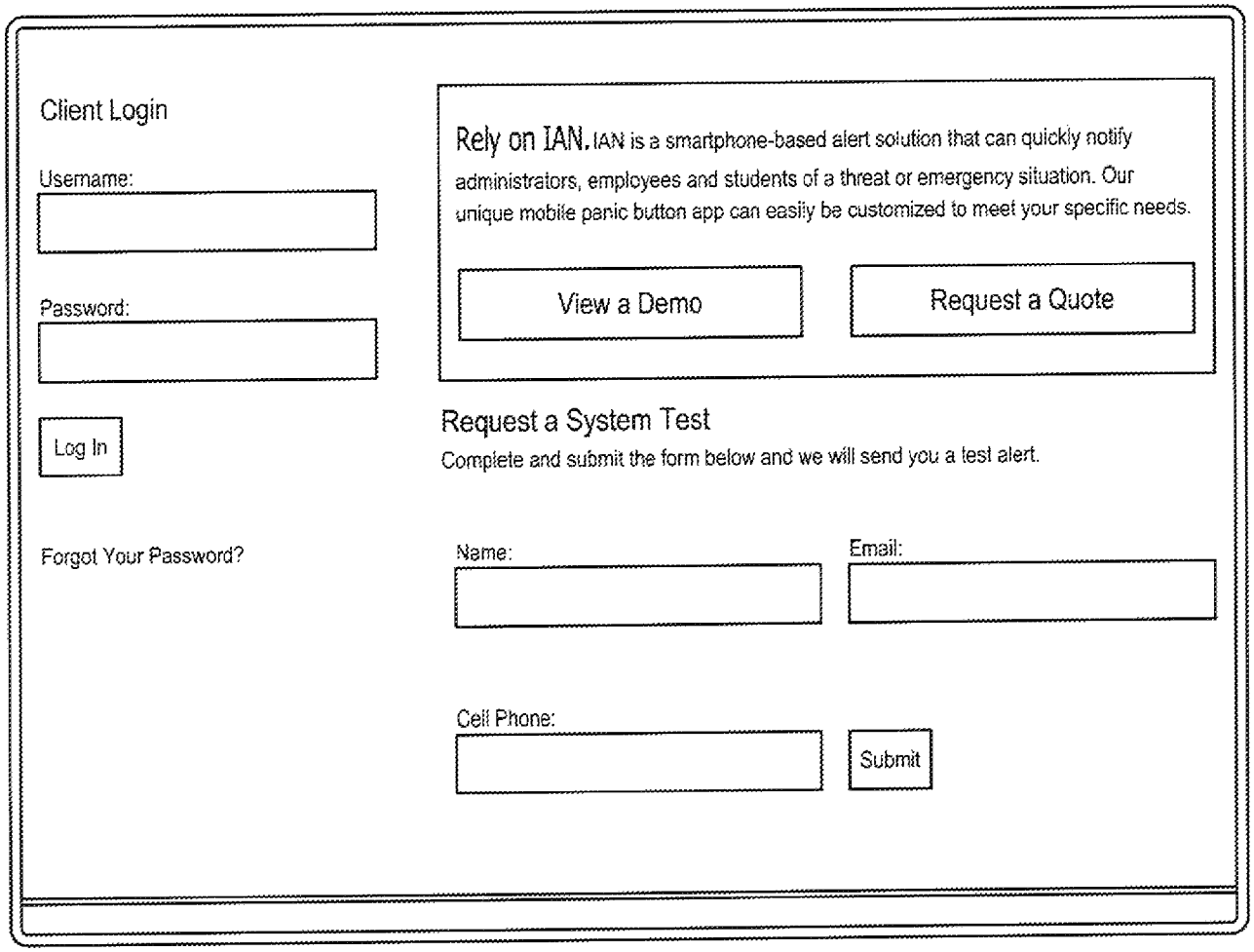
FIG. 2 depicts a screenshot of the login screen for an instant alert network system according to an embodiment of the present disclosure.

FIG. 2 depicts a screenshot of the login screen for an instant alert network system according to an embodiment of the present disclosure. The login screen may provide a means for the user to enter his/her username and password in order to obtain secure access to the instant alert network system. However, it should be appreciated that other means to obtain secure access may be utilized without departing from the present disclosure. In this embodiment of the present disclosure, by completing and submitting a form on the login screen, a user may request a test alert. The form may request information including but not limited to, name, e-mail address, and cell phone number.

Figure 3A:
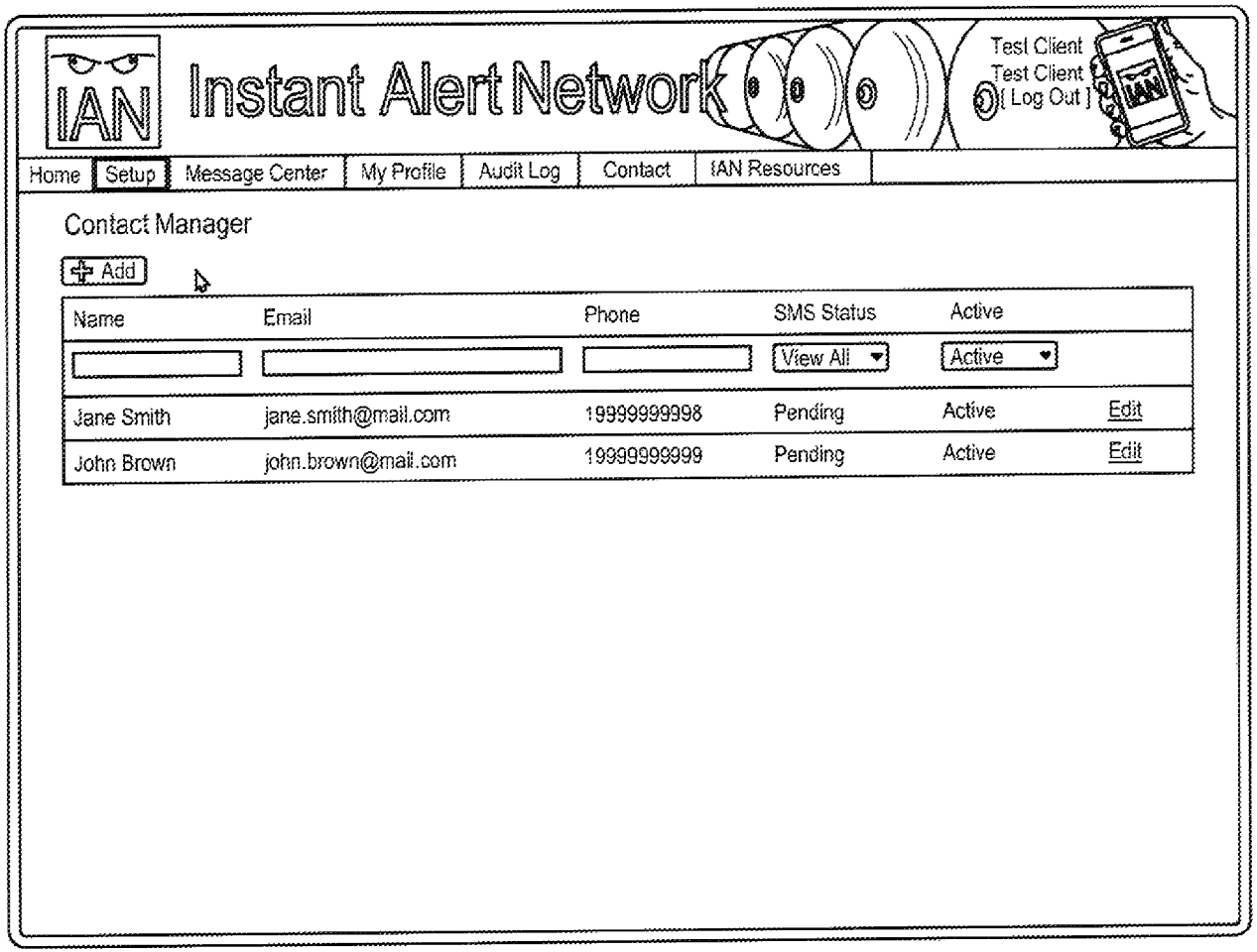
FIG. 3A depicts a screenshot of a contact management module for an instant alert network system according to an embodiment of the present disclosure.

FIG. 3A depicts a screenshot of a contact management module for an instant alert network system according to an embodiment of the present disclosure. The contact management module may provide a selection means so that a user may add contacts to the instant alert network system. As depicted in FIG. 3A, the contact management module may include information for each contact including but not limited to, the name of the contact, the contact's email address, the contact's phone number, and an indication as to whether the contact is an active user of the system at the time when the contact management module is accessed. It should be appreciated that more or less information may be provided for a given contact without departing from the present disclosure. For example, a contact may have more than one email address and/or phone number that may be included as part of the instant alert network system according to embodiments of the present disclosure. It also should be appreciated that the contacts may be selectable and sortable based on one or more of these items of information associated with a contact as depicted in FIG. 3A. Further, it should be appreciated that more details may be accessed for an individual contact by selecting the hyperlink "details" associated with the contact according to embodiments of the present disclosure. By selecting this hyperlink, a user may evaluate the groups associated with a given contact and adjust permissions according to embodiments of the present disclosure.

Figure 3B:
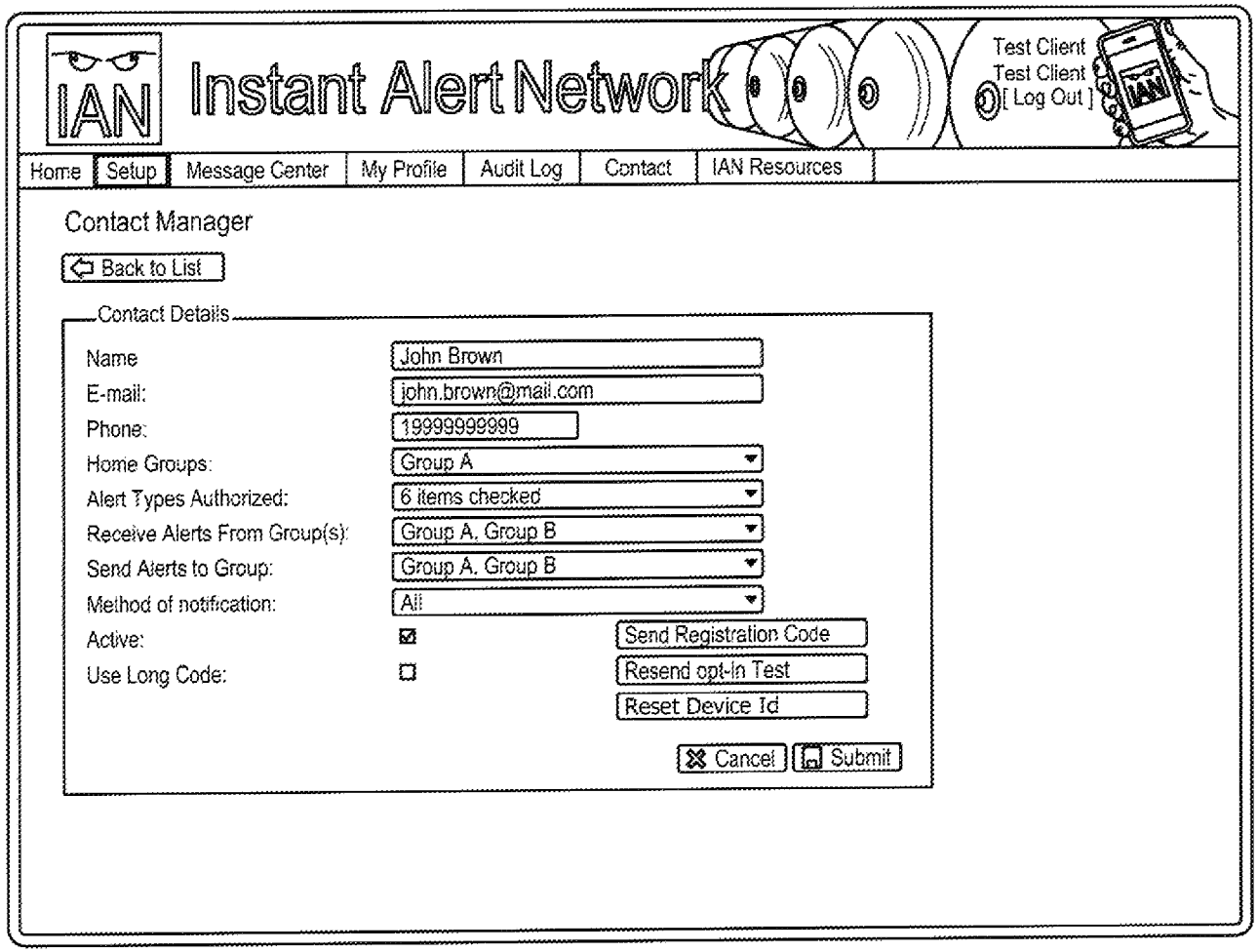
FIG. 3B depicts a screenshot of the contact addition mechanism for an instant alert network system according to an embodiment of the present disclosure.

As discussed with respect to FIG. 3A, contacts may be added through the contact management module of an instant alert network system according to embodiments of the present disclosure. A screenshot of the contact addition mechanism for an instant alert network system according to an embodiment of the present disclosure is depicted in FIG. 3B. When a user accesses the selection means to add a contact, the user may be provided with a screen wherein information about the particular contact may be added. Information about a contact may include but is not limited to, name, email address, phone number, home group identification (for sending and receiving alerts), from what groups the user may receive alerts, to what groups the user may send alerts, whether long code should be used, method (s) of notification, and an indication as to whether the contact is an active user of the system. As previously discussed, it should be appreciated that more or fewer items of information may be requested without departing from the present disclosure. In this embodiment of the present disclosure, the user is set up to receive alerts from two groups (Group A and Group B) and has permission (or has only opted or been given permission) to send alerts to two groups (Group A and Group B).

Figure 3C:
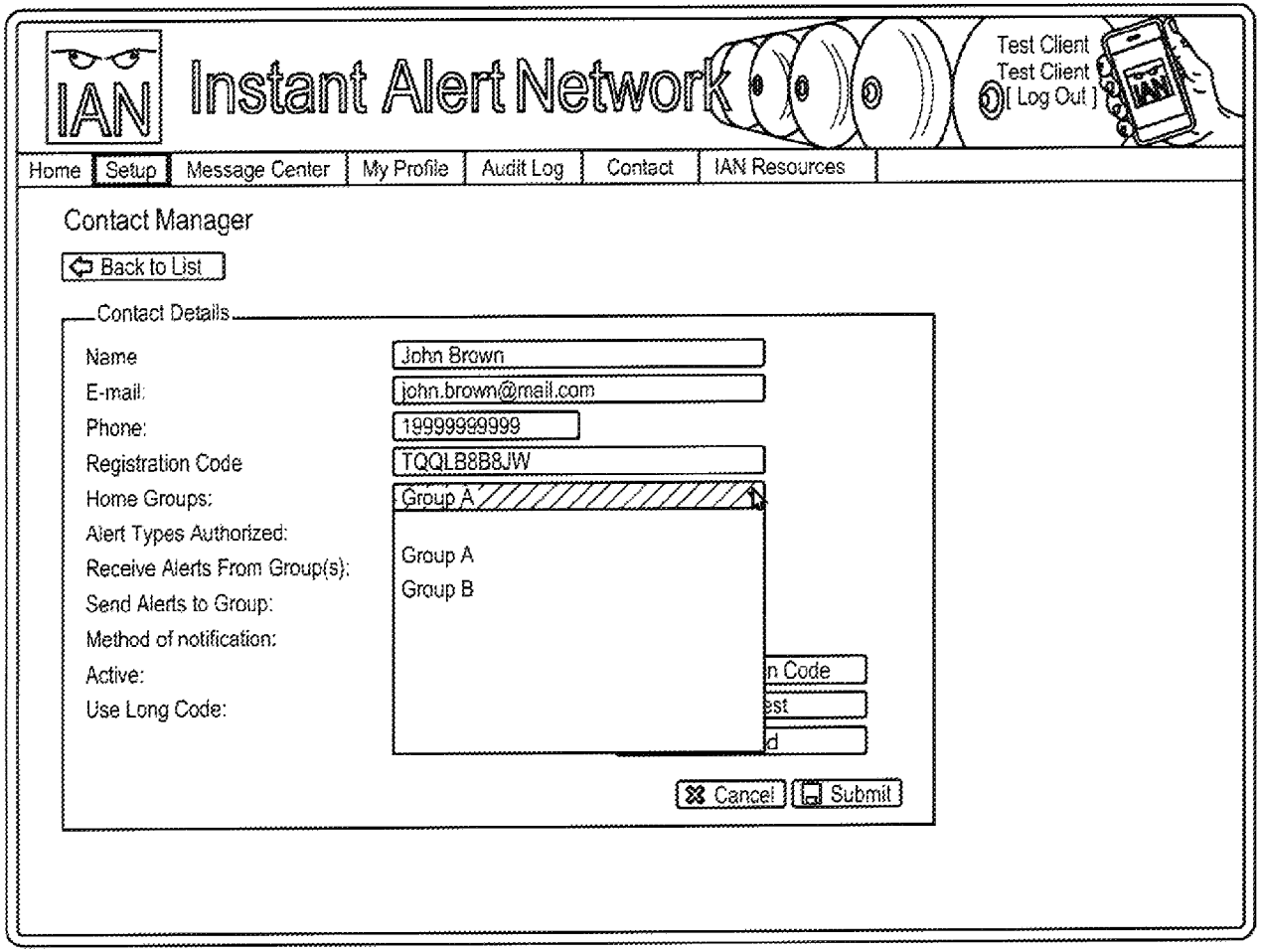
FIG. 3C depicts a screenshot of home group selection within the contact manager according to an embodiment of the present disclosure.

FIG. 3C depicts a screenshot of home group selection within the contact manager according to an embodiment of the present disclosure. In this embodiment, the user has selected to be identified with Group A, but Group B is another option for home group selection. It should be appreciated that a contact generally may only be associated with one home group. However, a contact may receive notifications from more than one group and may send notifications to more than one group without departing from the present disclosure.

Figure 3D:
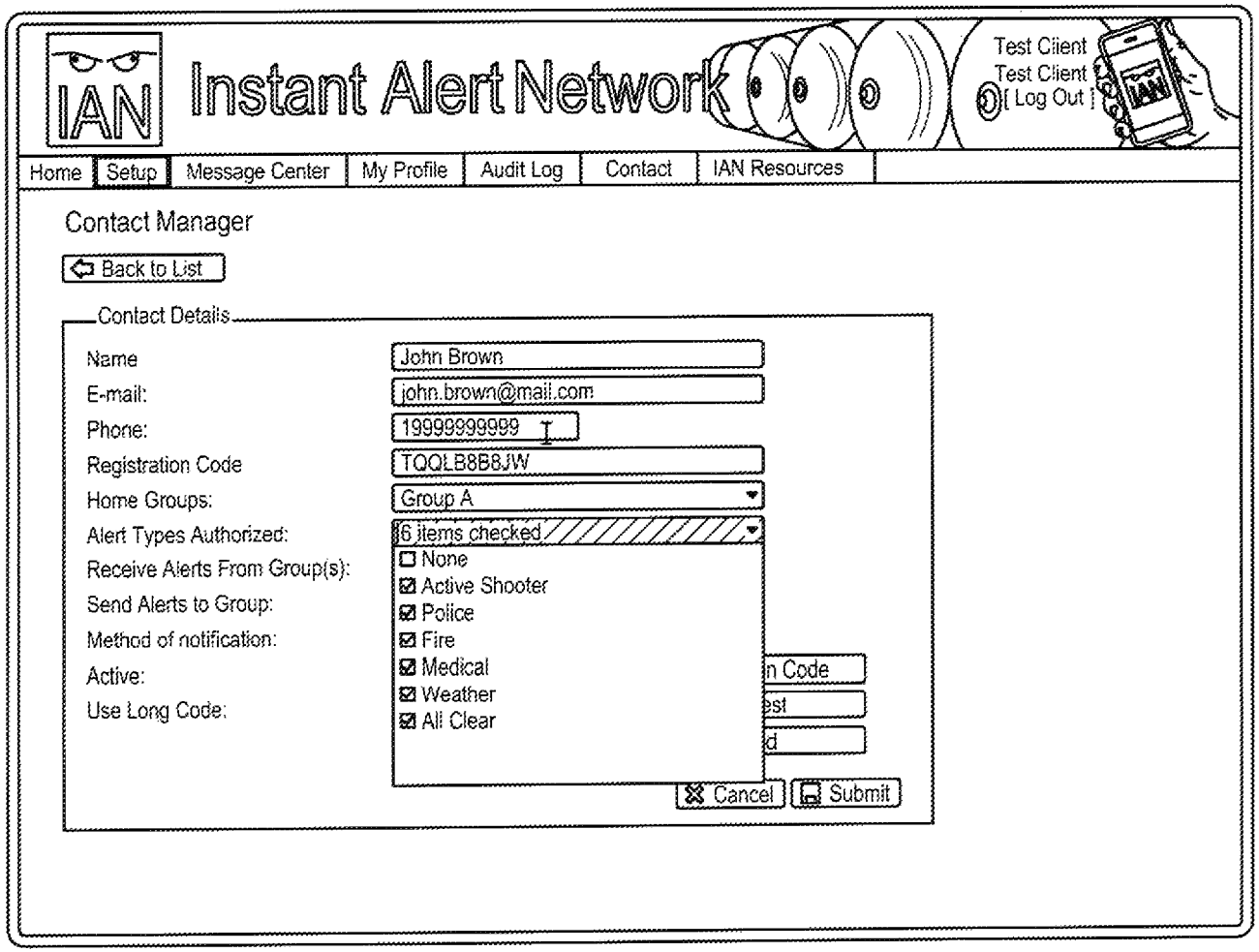
FIG. 3D depicts a screenshot of alert types authorized within the contact manager according to an embodiment of the present disclosure.

FIG. 3D depicts a screenshot of alert types authorized within the contact manager according to an embodiment of the present disclosure. In this embodiment, the user is presented with six types of alerts that he/she is authorized to send—active shooter, police, fire, medical, weather, and all clear—as well as a "none" selection. It should be appreciated that there may be embodiments of the present disclosure wherein a user may be presented with more or fewer than six types of alerts. It also should be appreciated that a user may be able to select or deselect types of alerts through different selection mechanisms without departing from the present disclosure. In this embodiment of the present disclosure, the user may check or uncheck alert types through a dropdown box. There also may be embodiments of the present disclosure wherein certain users may be given access to issue certain alerts. For example, only certain users may be authorized to issue the "all clear" alert to minimize false or premature alerting.

Figure 3E:
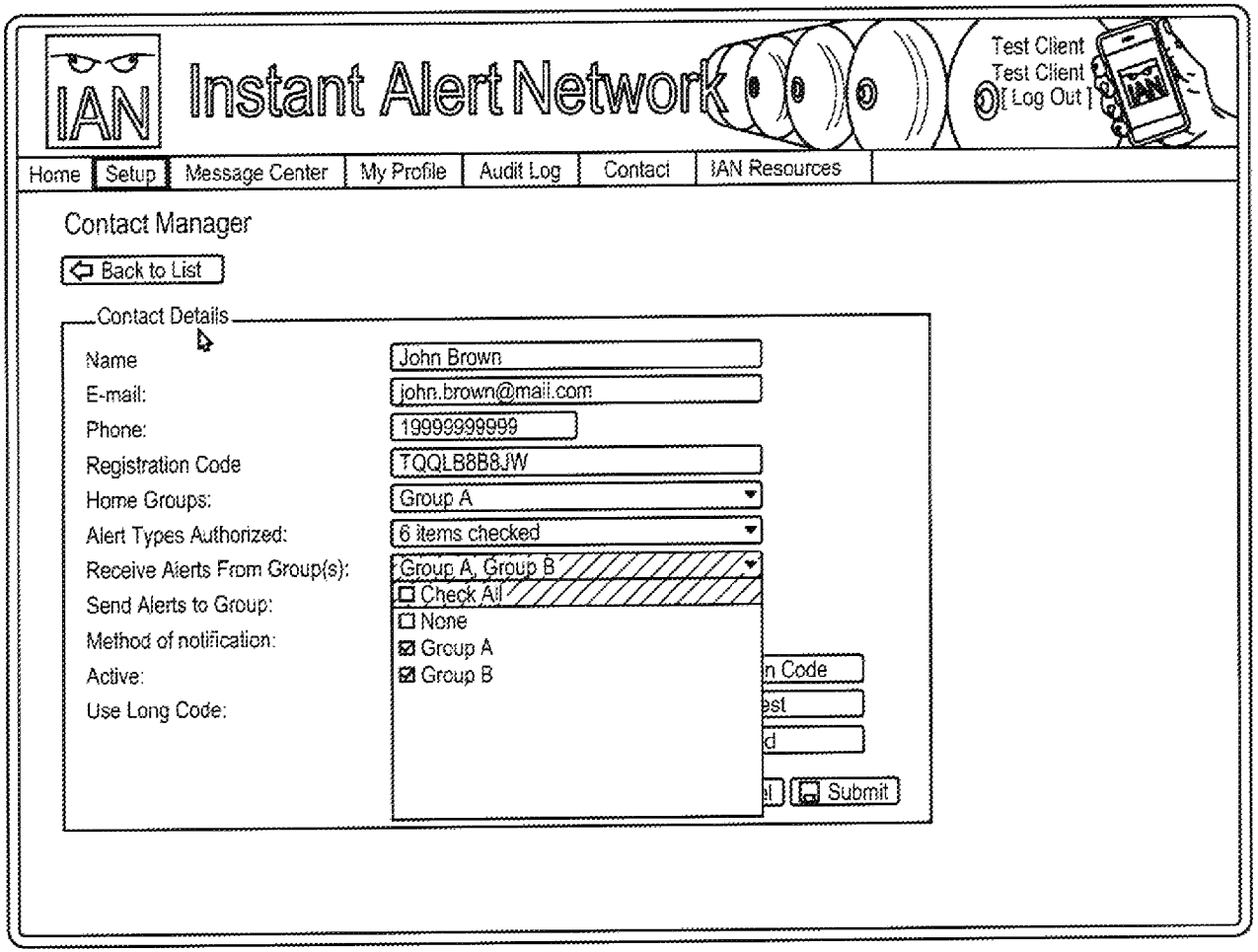
FIG. 3E depicts a screenshot of selecting from which groups to receive alerts according to an embodiment of the present disclosure.
Figure 3F:
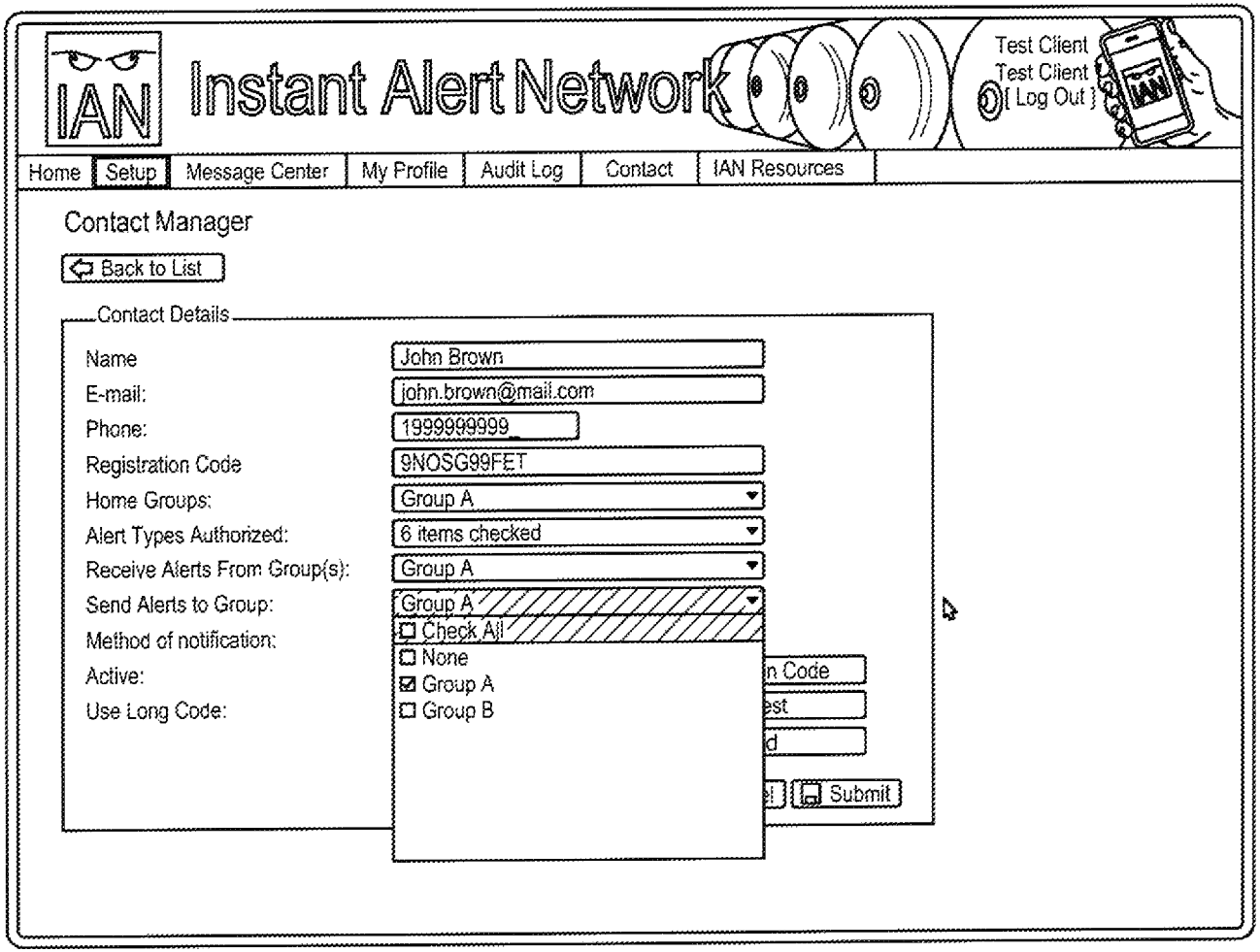
FIG. 3F depicts a screenshot of selecting to which groups he/she may send alerts according to an embodiment of the present disclosure.

FIG. 3E depicts a screenshot of selecting from which groups to receive alerts according to an embodiment of the present disclosure. As previously discussed with respect to selection of home groups, it should be appreciated that a user may be presented with a dropdown selection mechanism to identify one or more groups from which he/she may receive alerts. However, there may be embodiments of the present disclosure wherein a user may select not to receive any alerts (such as by selecting "none") when he/she is not in a geographical location where the alerts would be relevant or he/she may select to receive alerts from all authorized groups (such as by selecting "check all"). Similarly, FIG. 3F depicts a screenshot of selecting to which groups he/she may send alerts according to an embodiment of the present disclosure. A user may be presented with one or more group options to select, and the user also may be presented with "none" and "check all" options according to embodiments of the present disclosure.

Figure 3G:
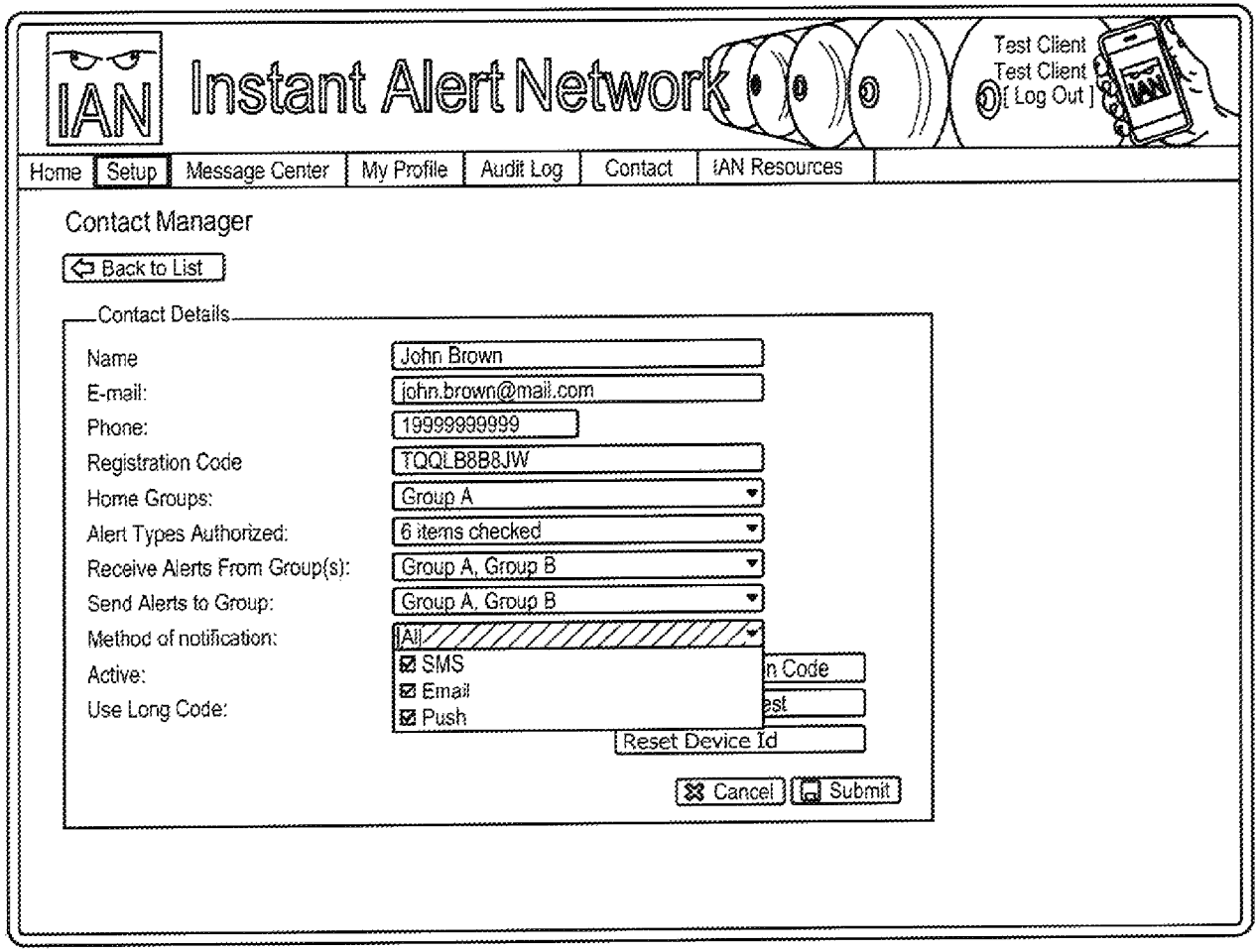
FIG. 3G depicts a screenshot of selecting one or more methods of notification within the contact manager according to an embodiment of the present disclosure.

FIG. 3G depicts a screenshot of selecting one or more methods of notification within the contact manager according to an embodiment of the present disclosure. It should be appreciated that a user may be presented with methods of notification from which to select that may include but are not limited to SMS, e-mail, and push notifications. It also should be appreciated that a user may elect to be notified through all available methods of notification or he/she may elect to receive notifications through only one method without departing from the present disclosure.

Figure 4A:
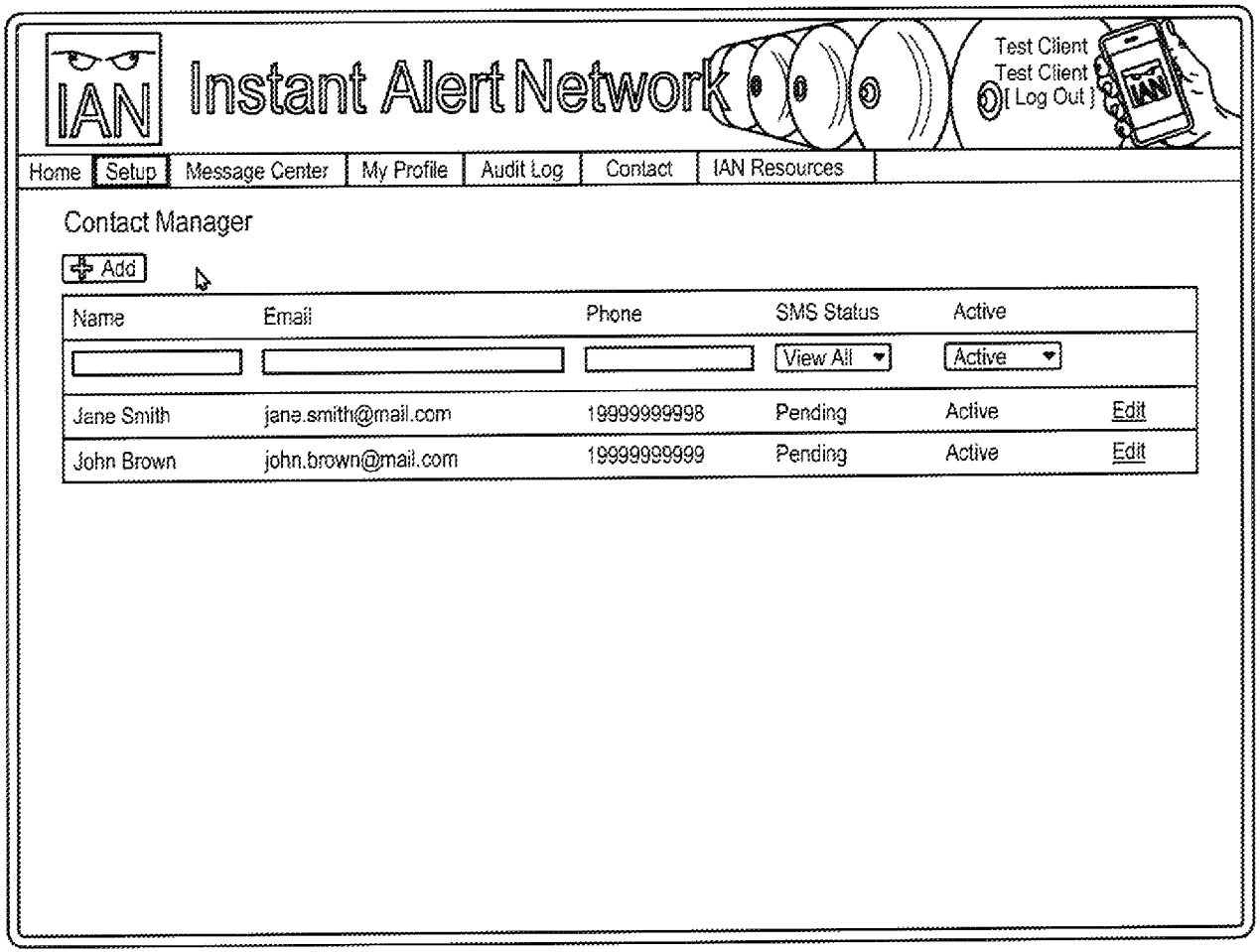
FIG. 4A depicts a screenshot indicating the status of a contact when it is added to the contact manager according to an embodiment of the present disclosure.

FIG. 4A depicts a screenshot indicating the status of a contact when it is added to the contact manager according to an embodiment of the present disclosure. When a contact is first added to the contact management module, the contact's status may be identified as "pending" subject to confirmation that he/she has permission to send or receive alerts from a given group according to embodiments of the present disclosure. Once the contact's permissions and status have been confirmed, the contact may be moved from "pending" status to "accepted." FIG. 4D depicts a screenshot indicating the change in status of a contact when it is accepted in the contact manager according to an embodiment of the present disclosure. This embodiment of the present disclosure depicts the contacts that are available on a given user's mobile device. For each contact, this screen may display the format in which the contact wishes to receive alerts (i.e., SMS or email) and the end point may display the phone number or email address associated with the format. If a user wishes to delete a contact from a group list, the user may select the "x" beside the contact's information. However, other methods of deletion or modification of contact entries may be utilized without departing from the present disclosure.

Figure 4B:
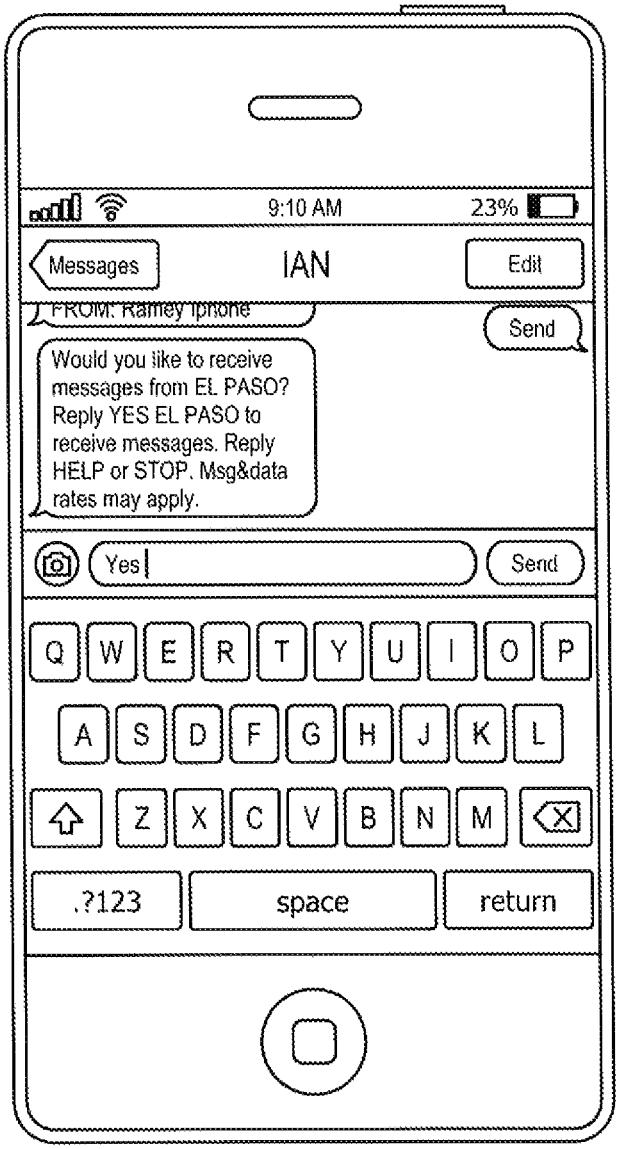
FIG. 4B depicts a screenshot of a notification that may be sent to a communication device of a "pending" user requesting that the user accept notifications from the instant alert system according to an embodiment of the present disclosure.

FIG. 4B depicts a screenshot of a request being sent to a mobile device asking the user to confirm whether he/she wishes to accept alerts from an instant alert network system according to an embodiment of the present disclosure. In this embodiment, a text message is sent to the user asking if he/she wishes to receive alert messages from the "El Paso" group. If the user wishes to receive these alert messages, the user is prompted to reply "yes" to receive messages. If the user elects not to receive these alert messages, he/she is prompted to reply using the word "stop." The user also may be provided with a means to get more information about the request by replying with the word "help" according to an embodiment of the present disclosure.

Figure 4C:
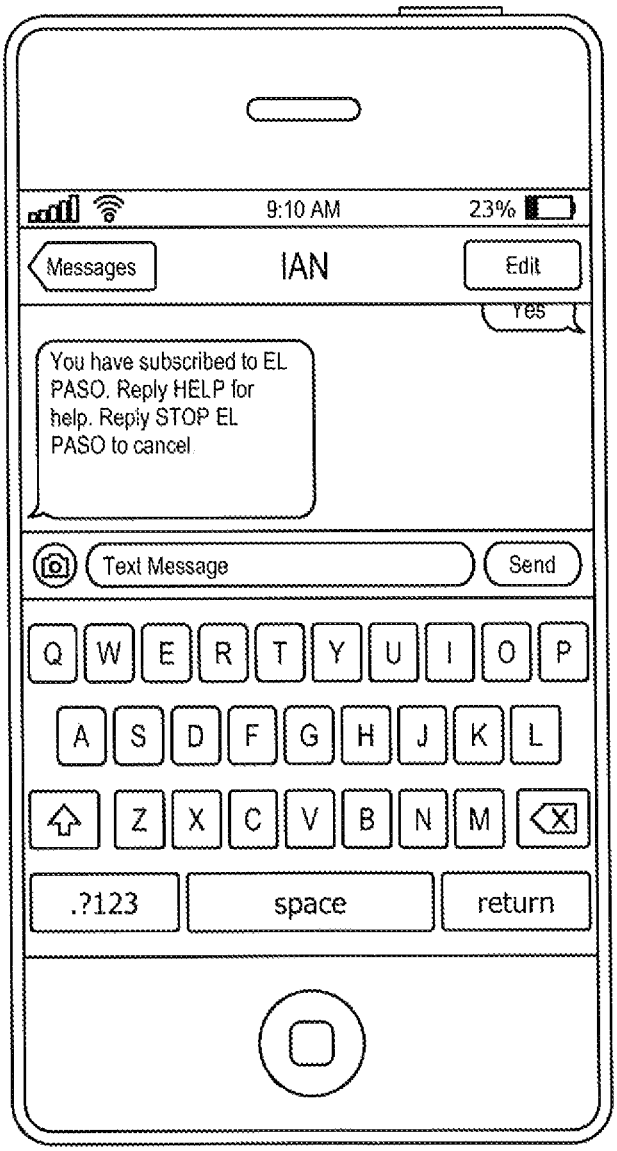
FIG. 4C depicts a screenshot of a confirmation message that a user may receive on his/her mobile device if the user wishes to receive alert messages from a given group associated with an instant alert network system according to an embodiment of the present disclosure.
Figure 4D:
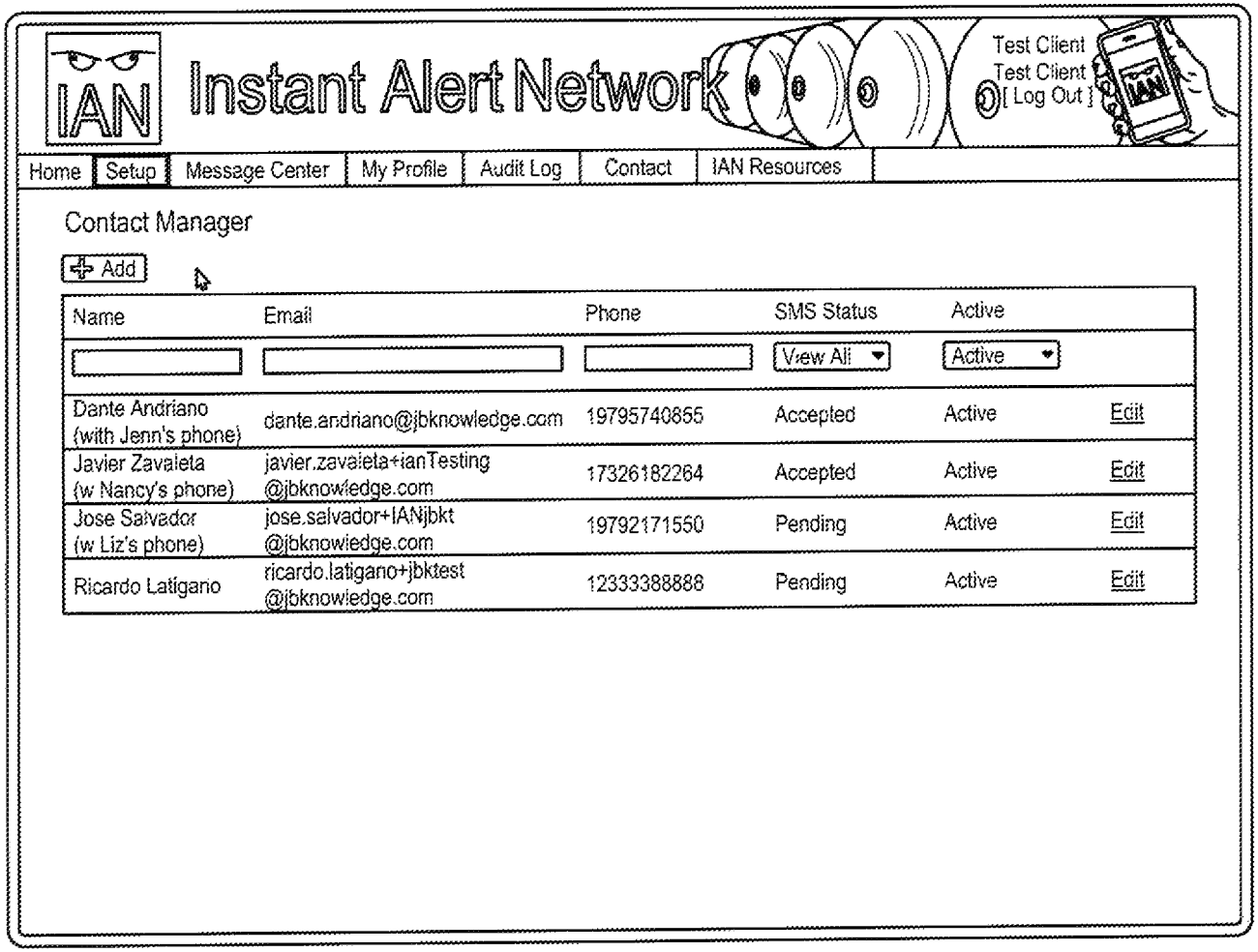
FIG. 4D depicts a screenshot indicating the change in status of a contact when it is accepted in the contact manager according to an embodiment of the present disclosure.

FIG. 4C depicts a screenshot of a confirmation message that a user may receive on his/her mobile device if the user wishes to receive alert messages from a given group associated with an instant alert network system according to an embodiment of the present disclosure. In this embodiment, the user may receive a message indicating that he/she has been subscribed to a certain group for the purpose of receiving alerts. If the user later requires help related to receiving alerts, he/she may reply using the word "help." The message also may provide information letting the user know how to reply to stop receiving alerts. This may be of use in the circumstances where the user leaves a geographical area and no longer requires receipt of these alerts when a threat arises in that area.

As previously discussed, each contact may be added to one or more groups. It should be appreciated that a contact may receive alerts from more than one group; however, the user's mobile device may be configured to transmit messages to a single group at any given time. In other embodiments of the present disclosure, a instant alert network system may be configured to provide a user with the ability to selectively transmit alerts to one or more groups without departing from the present disclosure.

Figure 5:
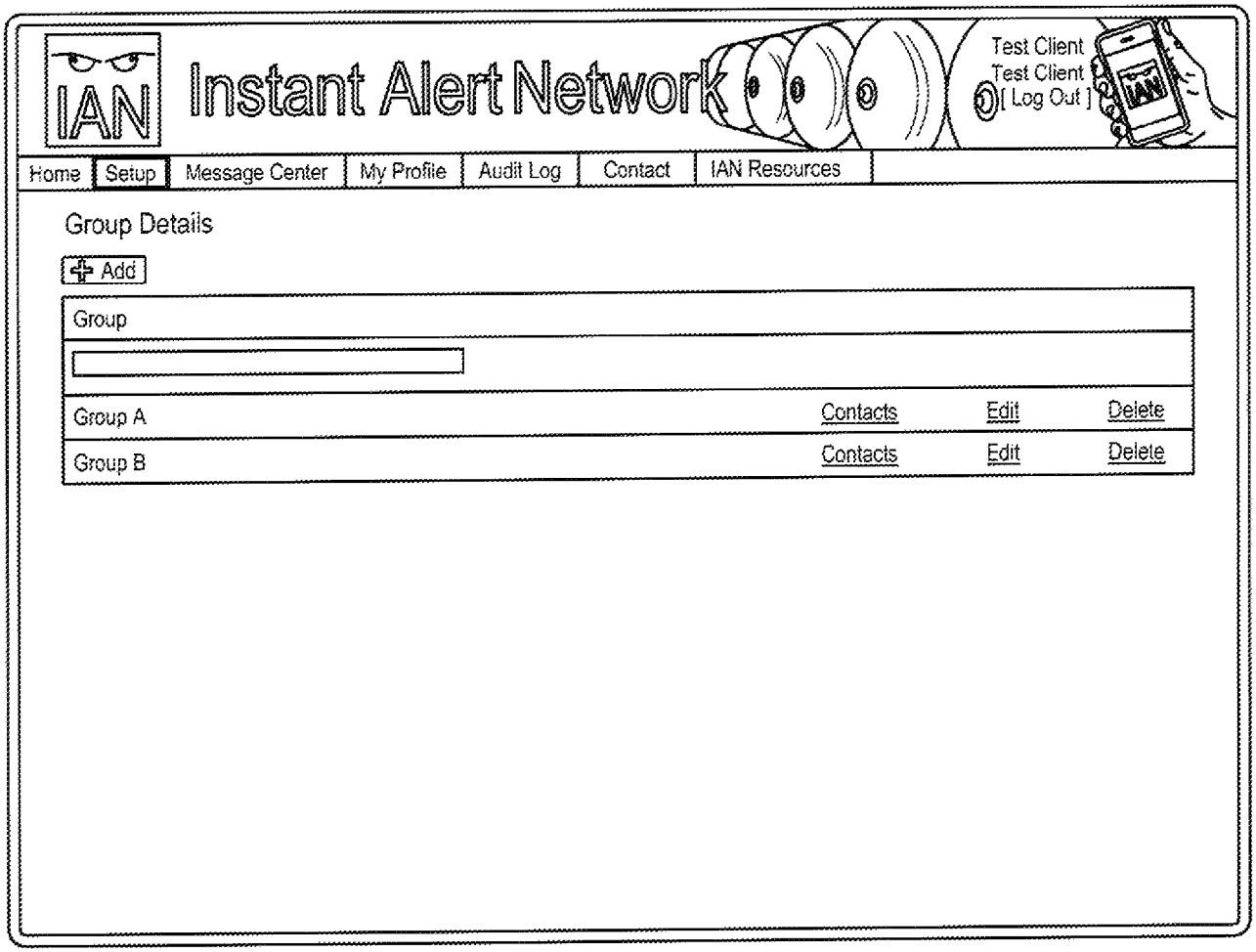
FIG. 5 depicts a screenshot of a group page in an instant alert network system according to an embodiment of the present disclosure.

FIG. 5 depicts a screenshot of a group page in an instant alert network system according to an embodiment of the present disclosure. The group page may be used to create distinct areas to receive and transmit alerts. In this embodiment, two groups have been established, and these groups may be based on geographical area (i.e., 5 different cities) or even location within an establishment (i.e., different floors of a school or hospital). This group page may provide hyperlinks in connection with each of the groups so that a user may access information concerning the contacts associated with a given group. It should be appreciated that more or fewer groups may be listed without departing from the present disclosure. An authorized user may edit a group or delete a group according to some embodiments of the present disclosure.

Figure 6A:
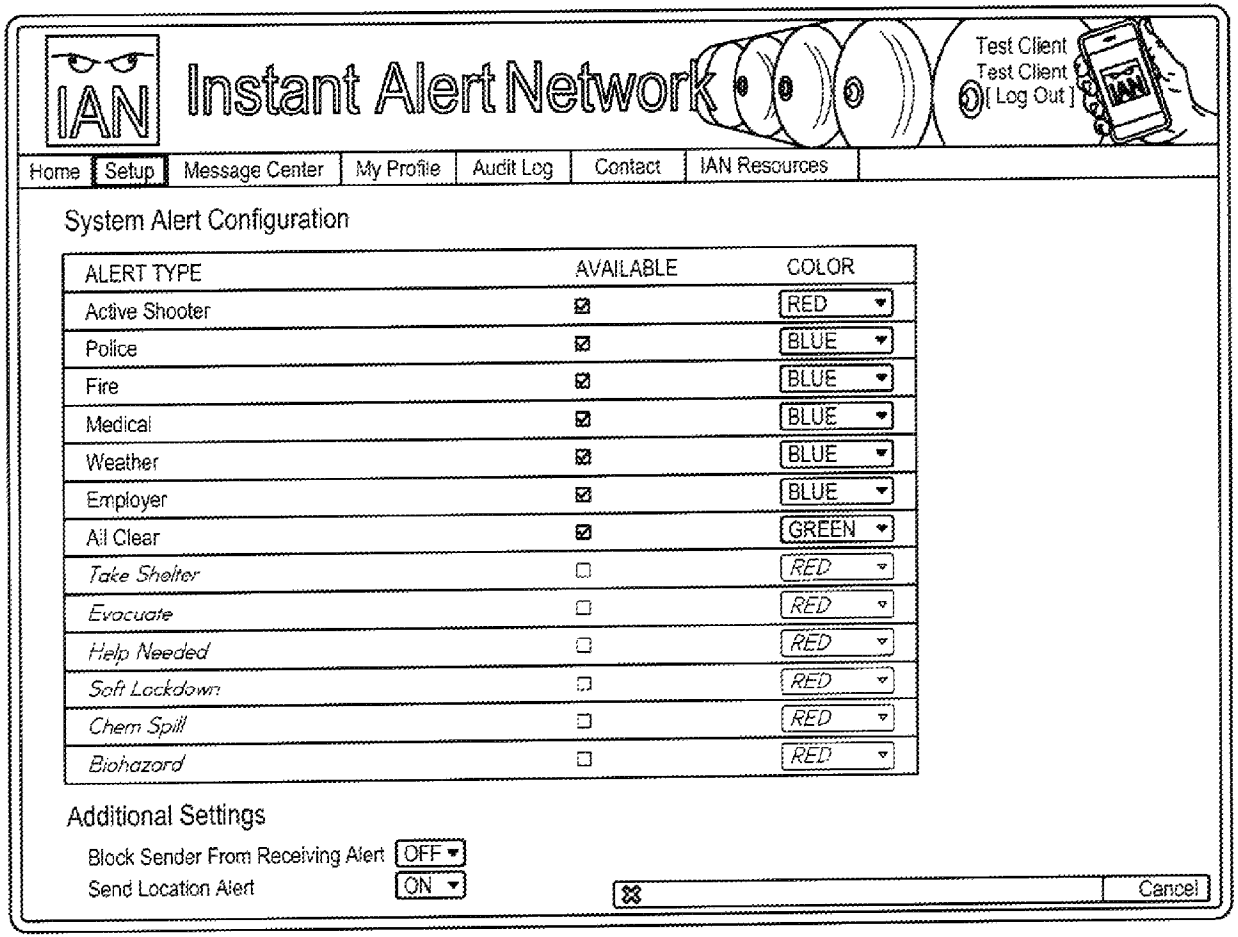
FIG. 6A depicts a screenshot for system alert configuration within an instant alert system according to an embodiment of the present disclosure.

FIG. 6A depicts a screenshot for system alert configuration within an instant alert system according to an embodiment of the present disclosure. An authorized user may configure one or more alert types. In this embodiment, the system alert configuration manager may include 13 alert types from which an authorized user may select. These alert types include but are not limited to, active shooter, police, fire, medical, weather, employer, all clear, take shelter, evacuate, help needed, soft lockdown, chemical spill, and biohazard. However, there may be embodiments of the present disclosure wherein an authorized user may be presented with more or fewer alert types. In configuring the alert types, an authorized user may select which alert types may be available to contacts, and the authorized user also may select a color to be associated with each alert type. This color will be associated with the icon displayed on a recipient's communication device, and colors may include but are not limited to red, green and blue. Additional settings also may be provided within the system alert configuration, such as whether to block a sender from receiving a certain alert or whether to send a location alert according to embodiments of the present disclosure.

Figure 6B:
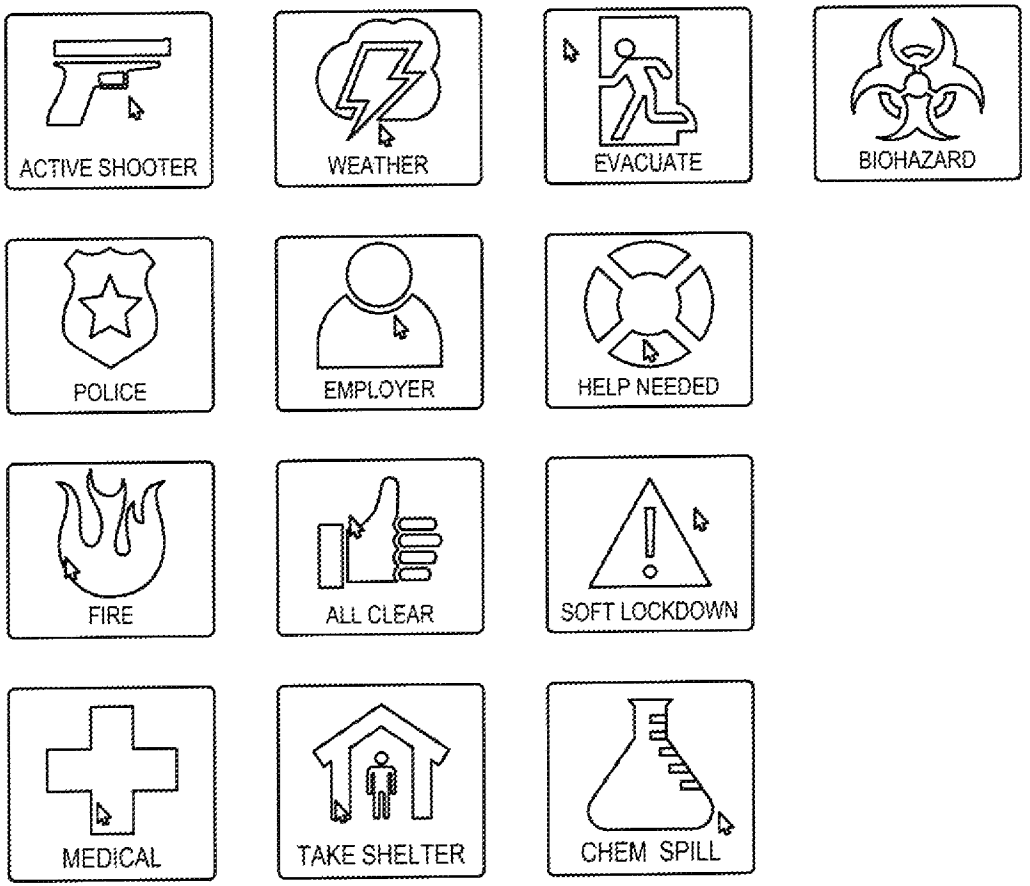
FIG. 6B depicts different alert types within an instant alert system according to an embodiment of the present disclosure.

FIG. 6B depicts different alert types within an instant alert system according to an embodiment of the present disclosure. These alert types may include but are not limited to active shooter, police, fire, medical, weather, employer, all clear, take shelter, evacuate, help needed, soft lockdown, chemical spill, and biohazard according to embodiments of the present disclosure. While each alert type has an associated icon, it should be appreciated that there may be embodiments of the present disclosure where a different icon may be associated with an alert type. Further, there may be embodiments of the present disclosure wherein the text identifying the alert type may not be included with the icon.

Figure 7:
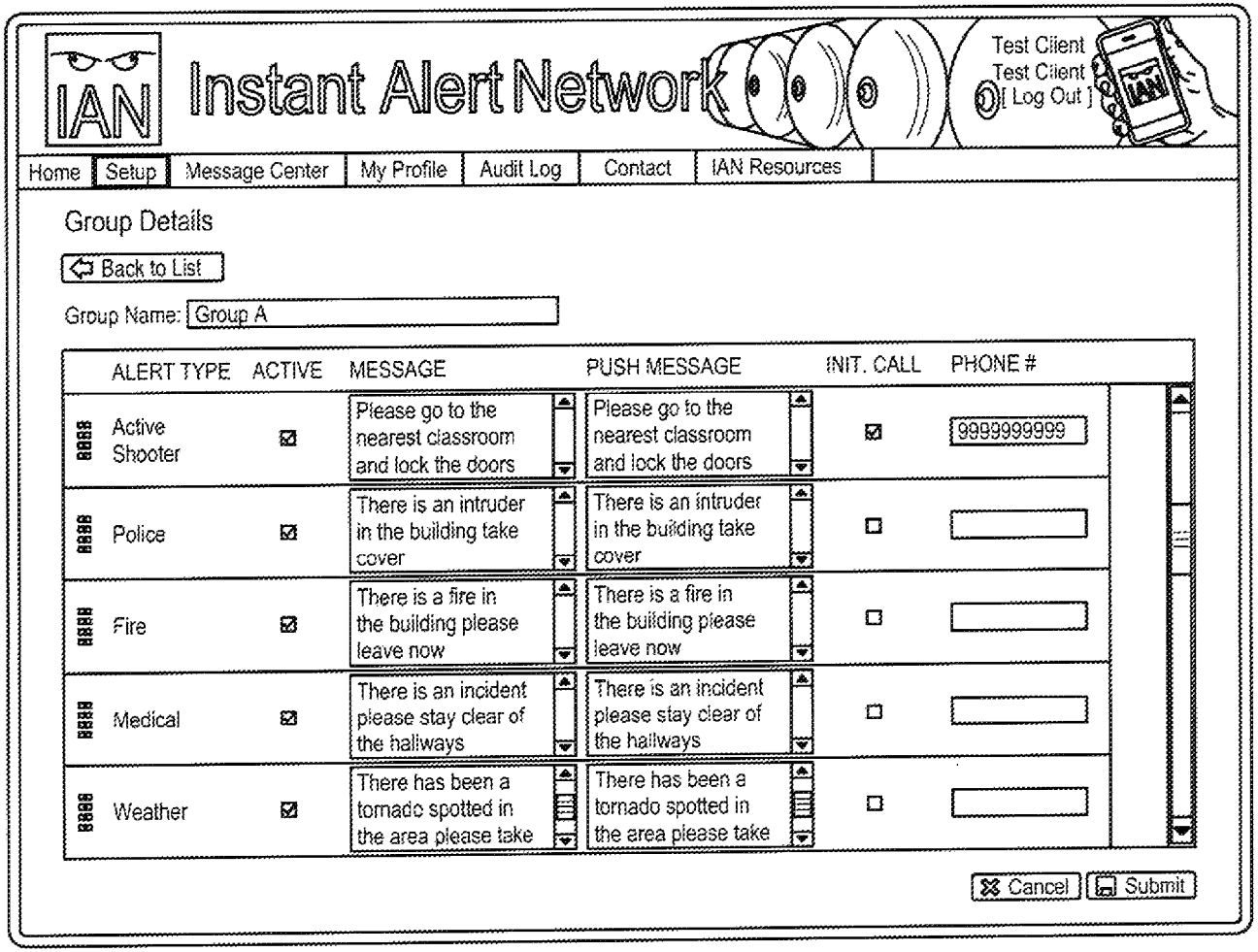
FIG. 7 depicts a screenshot of group details that may be established within an instant alert system according to an embodiment of the present disclosure.

FIG. 7 depicts a screenshot of group details that may be established within an instant alert system according to an embodiment of the present disclosure. In this embodiment, Group A may include five alert types (active shooter, police, fire, medical and weather) that may be selected to be active with respect to the group. Each alert type may have at least one message associated with it. With respect to the active shooter alert type, one message may be "please go to the nearest classroom and lock the doors." This message may be sent via one or more notification methods. In an embodiment of the present disclosure, one message may be sent via text message and/or email while another message may be sent via push notification; however, it should be appreciated that the same message may be sent via push notification and other notification methods without departing from the present disclosure. FIG. 7 also depicts messages that may be sent with respect to the police alert type ("there is an intruder in the building take cover"), the fire alert type ("there is a fire in the building please leave now"), the medical alert type ("there is an incident please stay clear of hallways"), and weather alert type ("there has been a tornado spotted in the area please take cover") according to an embodiment of the present disclosure. While certain messages are identified as being associated with different alert types, it should be appreciated that the message boxes within this group details portion of the instant alert system may be selectively modifiable without departing from the present disclosure. FIG. 7 further depicts how each alert type may be selected to initiate a call and a phone number may be associated with the call according to embodiments of the present disclosure.

Figure 8A:
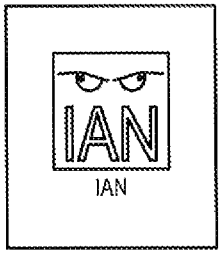
FIG. 8A depicts an application icon that may be associated with a mobile application of an instant alert network system according to an embodiment of the present disclosure.
Figure 8B:
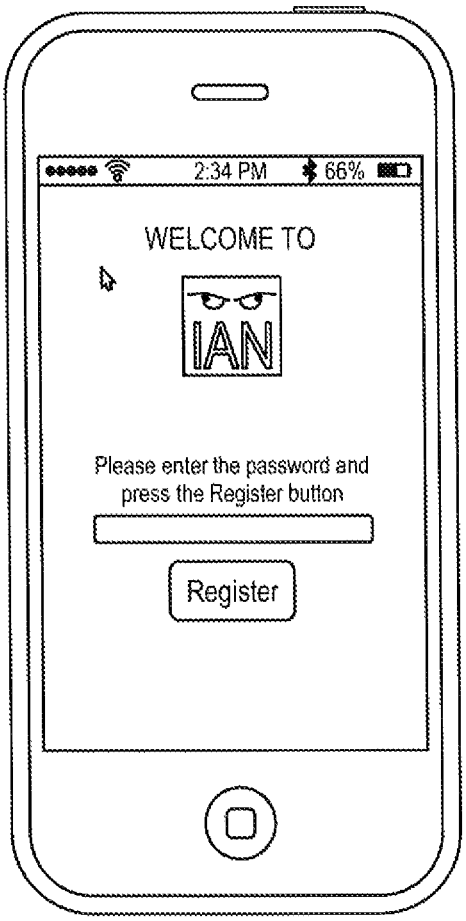
FIG. 8B depicts a screenshot of a registration screen for a mobile application of an instant alert network system according to an embodiment of the present disclosure.
Figure 8C:
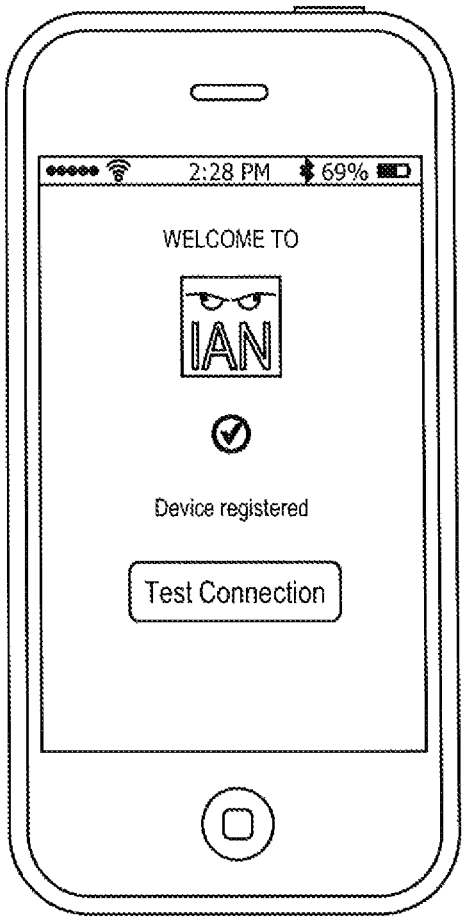
FIG. 8C depicts a screenshot of testing a connection to an instant alert network system when the application is installed on the user's mobile device according to an embodiment of the present disclosure.

FIG. 8A depicts an application icon that may be associated with a mobile application of an instant alert network system according to an embodiment of the present disclosure. FIG. 8B depicts a screenshot of a registration screen for a mobile application of an instant alert network system according to an embodiment of the present disclosure. When the mobile application is installed on a user's mobile device, the user may be prompted to enter a registration code that may be sent from an administration website when a contact has been created. The user may enter a password or registration code that may be sent from an administration website, and then the user may select "register" according to an embodiment of the present disclosure. After the application is installed or registered with the user's mobile device, a screen may be presented confirming the registration with an input mechanism, such as a button, that may allow the user to test his/her connection with the instant alert system as depicted in FIG. 8C.

Figure 8D:
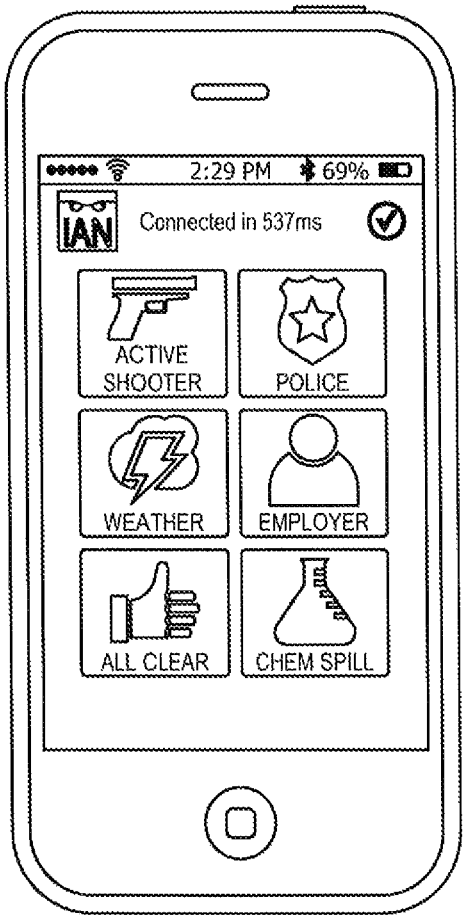
FIG. 8D depicts a screenshot presenting a user with alert buttons that have been configured for the user of an instant alert system according to an embodiment of the present disclosure.

FIG. 8D depicts a screenshot presenting a user with alert buttons that have been configured for the user of an instant alert system according to an embodiment of the present disclosure. This screen may be presented when the user selects the instant alert system application icon in an embodiment of the present disclosure.

Figure 8E:
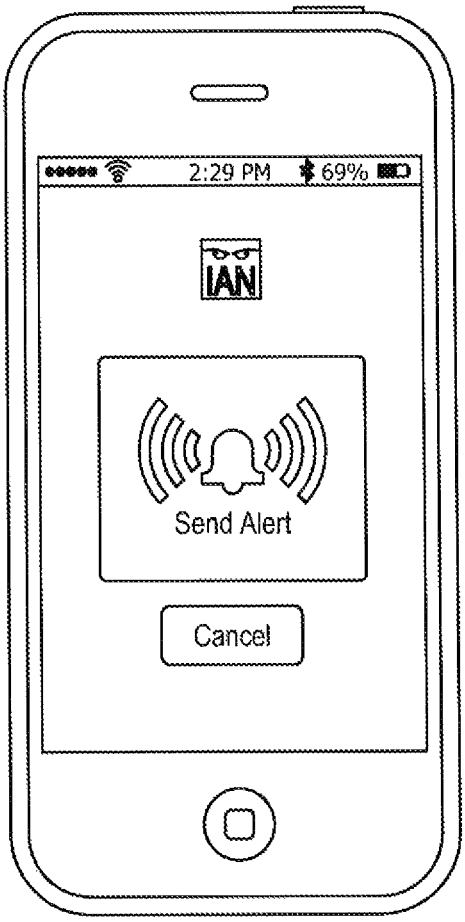
FIG. 8E depicts a screenshot of a prompt for a user to confirm that he/she wishes to access the instant alert network system to send an alert according to an embodiment of the present disclosure.

Upon selection of the application icon, the user may be prompted to request confirmation that he/she wishes to access the instant alert network system to send an alert as depicted in FIG. 8E. This may be effectuated by selecting a "confirm" or "send alert" button; however, other mechanisms to confirm the instruction to access the system may be utilized without departing from the present disclosure.

Figure 8F:
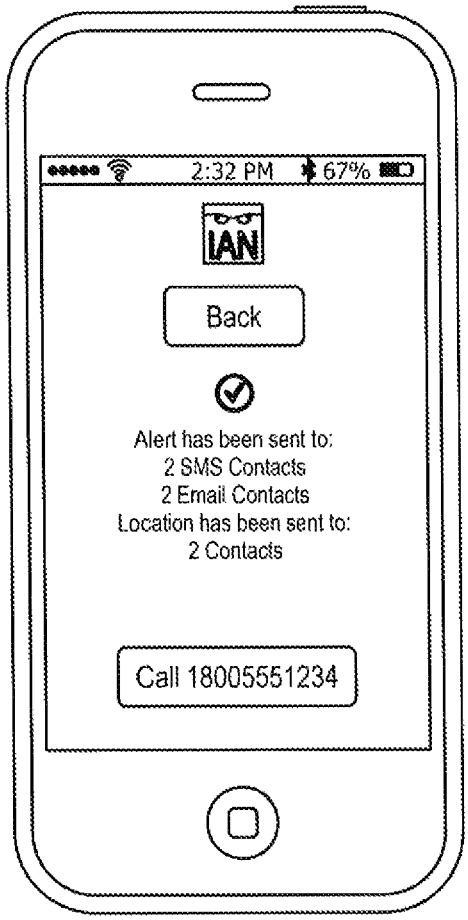
FIG. 8F depicts a screenshot wherein the user may receive a confirmation page that displays the alerts that have been sent according to an embodiment of the present disclosure.

When the user confirms that he/she wishes to access the instant alert network system, in a scenario where the user may only send alerts to a single group, notifications or alerts may be sent to each contact within the single group that is associated with the user's mobile device. FIG. 8F depicts a screenshot wherein the user may receive a confirmation page that displays the alerts that have been sent according to an embodiment of the present disclosure. In this embodiment, an alert has been sent to 2 SMS contacts, 2 email contacts, and location information has been sent to 2 contacts. Further, in an embodiment of the present disclosure, this screen may present the user with an option to call a number and/or a "back" button that may permit the user to return to the alert selection page, such as to send further or different alerts.

Figure 8G:
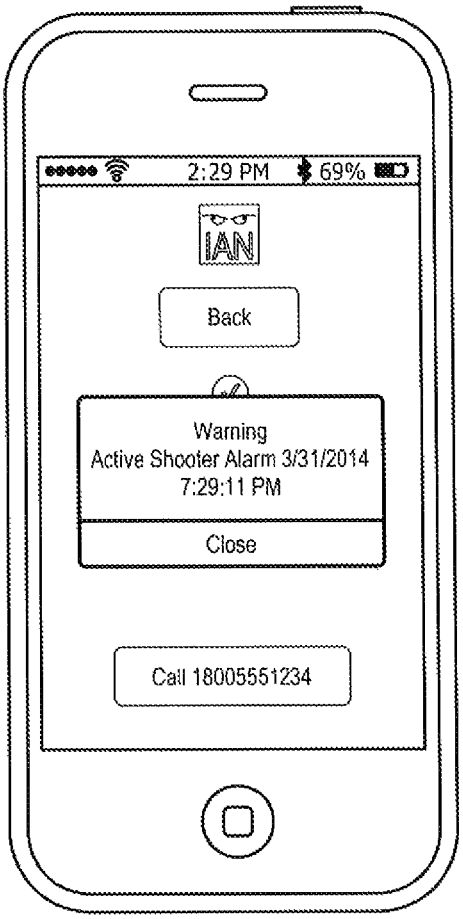
FIG. 8G depicts a screenshot of a push notification through the instant alert system according to an embodiment of the present disclosure.

FIG. 8G depicts a screenshot of a push notification through the instant alert system according to an embodiment of the present disclosure. Push notifications may appear on a user's communication device depending on the configuration of the device according to embodiments of the present disclosure. The push notification may overlay on the screen depicted in FIG. 8F or it may appear as a separate screen according to embodiments of the present disclosure. The user may be presented with an option to selectively close the push notification without departing from the present disclosure.

It should be appreciated that alerts may be sent to mobile communication devices; however, alerts also may be sent to non-mobile communication devices, such as a desktop computer that may be connected to a communication network to receive email without departing from the present disclosure. In other embodiments of the present disclosure, if the user is granted permission to selectively send alerts to different groups or to more than one group at the same time, it should be appreciated that one or more screens may be added to the mobile application accessed on a user's mobile device to allow the user to select different groups to whom he/she may transmit alerts. Further, while an instant alert network system has been described as being configured to use on a mobile communication device, it should be appreciated that applications may be provided for access through a website on a non-mobile communication device, such as a desktop computer, without departing from the present disclosure.

Figure 9:
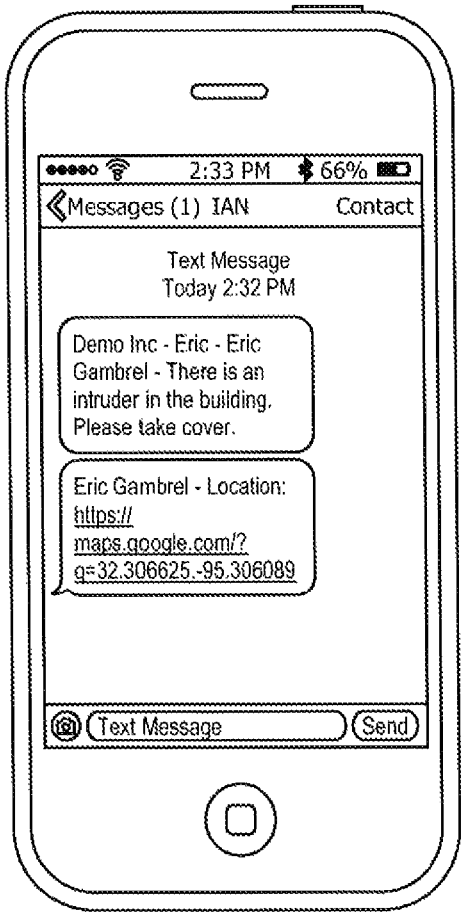
FIG. 9 depicts a screenshot of an alert message that may be received by a contact within a group according to an embodiment of the present disclosure.

FIG. 9 depicts a screenshot of an alert message that may be received by a contact within a group according to an embodiment of the present disclosure. In this embodiment, the contact may be informed that there is an intruder in the building and that those affected should take cover. The alert also may identify the user who transmitted the alert and also may provide GPS or other location information within the same alert or a subsequent alert according to embodiments of the present disclosure. This identification may be of assistance so that the contact may have a better idea of direct applicability of the alert. For example, in a group associated with a school, if the history teacher (whose classroom is on the first floor of the school) transmits the alert, the science teacher (whose classroom is on the second floor of the school) receiving the alert may be able to conclude that the security risk may be focused on the first floor, and he/she may have more time to take action. It should be appreciated that the user sending an alert may be prompted to provide more information that may be associated with the alert at his/her option without departing from the present disclosure. In other embodiments of the present disclosure, the user may be prompted to select one or more predetermined alerts to be transmitted so as to expedite the transmittal. In further embodiments of the present disclosure, the user also may be permitted to provide a follow up alert that includes additional information about the nature of the alert without departing from the present disclosure.

It should be appreciated that an instant alert network system according to embodiments of the present disclosure may be formed as a redundant system. By having a redundant system, there may be a secondary system that may take over and still be operational to distribute and manage alerts even when the primary system fails. This may be advantageous, for example, if a weather situation (i.e., a hurricane or tornado) were to arise wherein the location where the primary servers or the network are located is adversely affected by the weather. The secondary severs or network may be established in a different location and may take over to continue operations of the system according to embodiments of the present disclosure.

While embodiments of the present disclosure have been described as communicating alerts to other users, it also should be appreciated that an instant alert network system may be established so that alerts may be selectively transmitted to police or fire personnel without departing from the present disclosure. In some embodiments of the present disclosure, the fire department for a given geographical location may be added to a group so that it receives all alerts from that group. In other embodiments of the present disclosure, the fire department may selectively receive alerts from the group containing one or more trigger words (i.e., "fire") so that the fire department does not receive alerts that are not relevant to its operations.

It should be appreciated that the permissions for a given user of an instant alert network system may be modified according to embodiments of the present disclosure. As such, there may be some system users that have the authority to send alerts to a given group or to certain contacts within a group. For example, teachers at a school may be permitted to send alerts that may be received by others within the group (i.e., teachers, administrators, other school personnel) in an embodiment of the present disclosure. In another embodiment of the present disclosure, a teacher may be permitted to send an alert; however, that alert may be routed directly to school administrators. In this embodiment, only the school administrators may have the authority to send an alert to the entire group. This may be advantageous so that there may be some evaluation of the type of alert before the entire group is notified. It should be appreciated that groups may be selectively permissioned according to embodiments of the present disclosure.

An instant alert system according to embodiments of the present disclosure may allow any authorized user to initiate an alert from his/her communication device. Such an instant alert system may allow for rapid means to notify all impacted individuals or entities of an impending security threat or emergency situation. This instant alert system may be used by organizations as part of an overall safety, security, and evacuation plan. It should be appreciated that an instant alert system according to embodiments of the present disclosure may be flexible in terms of the types of alerts, methods of alerting, and alert recipients such that accurate, up-to-the-minute information may be disseminated in an efficient and effective manner.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A method for activating an instant alert network system, the method comprising:

using a communication device, contacting a secure web service over a wireless communication network to access a contact database housed on one or more servers to obtain contact information;

selecting one or more contacts within the contact database, the one or more contacts affected by a threat;

selecting an alert type from an alert type selection module using a set of dynamic buttons; and transmitting in real-time, without first communicating with an administrator, an alert including a message providing instructions about how to respond to the alert directly to the one or more selected contacts, wherein the alert type selection module generates the message based on the selected alert type, wherein each of the contacts within the contact database can transmit the alert of the threat to the one or more selected contacts without first transmitting a communication to the administrator.

2. The method of claim 1, wherein the one or more contacts are assigned to a user-defined group within the contact database, and the alert of the threat is transmitted to the one or more contacts within the user-defined group.

3. The method of claim 1, wherein the one or more contacts are assigned to more than one user-defined group within the contact database, and the alert of the threat is transmitted to the one or more contacts within at least one user-defined group.

4. The method of claim 1, further comprising:

transmitting location-based information associated with the threat to the one or more selected contacts.

5. The method of claim 4, wherein the location-based information associated with the threat is transmitted in the same alert notifying the one or more selected contacts of the threat.

6. The method of claim 1, wherein the alert is transmitted through at least one of the following transmittal methods:

text message, e-mail message, and push notification.

7. The method of claim 1, wherein the alert is selected from the group comprising:

active shooter, police, fire, medical, weather, employer, all clear, evacuate, help needed, take shelter, soft lockdown, chemical spill, and biohazard.

8. An instant alert network system, the system comprising:

a contact management module, wherein each contact included in the contact management module is associated with at least one communication method through which the contact receives instant alerts, a home group with which the contact is associated, from what groups the contact can send instant alerts, and to what groups the contact can send instant alerts; and an alert type selection module providing a contact with a set of dynamic buttons from which to select an alert type, wherein, using a communication device, any one of the contacts included in the contact management module selects one or more additional contacts within the contact management module and an alert type from the alert type selection module to send an instant alert associated with the alert type to communication devices of the selected one or more contacts over a wireless communication network without first communicating with an administrator, wherein the alert type selection module associates a message providing instructions about how to respond to the alert type that is sent to the one or more additional contacts when the alert type is sent as part of the instant alert.

9. The instant alert network system of claim 8, wherein each contact included in the contact management module includes additional information selected from the following:

contact name, contact email address, contact phone number, and an identification of whether the contact is an active user of the instant alert network system.

10. The instant alert network system of claim 8, wherein the at least one communication method is selected from the group comprising:

email, voicemail, text message, and push notification.

11. The instant alert network system of claim 8, wherein the instant alert is selected from the group comprising:

active shooter, police, fire, medical, weather, employer, all clear, evacuate, help needed, take shelter, soft lockdown, chemical spill, and biohazard.

12. The instant alert network system of claim 8, wherein the selected one or more contacts are in a geographical location associated with the threat.

13. The instant alert network system of claim 8, wherein the selected one or more contacts are affiliated with a single group within the contact management module.

14. The instant alert network system of claim 8, wherein the selected one or more contacts are affiliated with more than one group within the contact management module.

15. The instant alert network system of claim 8, further comprising:

a location-based tracking mechanism associated with the communication device of the authorized user, wherein the instant alert network system detects the location of the communication device of the authorized user and transmits the location information to the selected one or more contacts.

16. The instant alert network system of claim 15, wherein the location-based tracking mechanism is global positioning system (GPS).

17. A method for transmitting an instant alert using a mobile communication device, the method comprising:

accessing an instant alert system housed on one or more servers over a wireless communication network, wherein the instant alert system permits any one of a plurality of users to transmit the instant alert to one or more of the plurality of users without first communicating with an administrator;

selecting at least one group within the plurality of users to receive an instant alert, the at least one group selected from the plurality of users identified in a secure contact management database housed on the one or more servers;

using a set of dynamic buttons, selecting an alert type from an alert type selection module to be transmitted to the at least one group, the alert type associated with an emergency situation; and transmitting the instant alert including the selected alert type to the at least one group over the wireless communication network in real-time without first communicating with the administrator, the instant alert further including an identification of the one of the plurality of users transmitting the instant alert, a date and time associated with the instant alert, and at least one instruction for how to respond to the instant alert.

18. The method for transmitting an instant alert using a mobile communication device of claim 17, further comprising:

transmitting GPS coordinates associated with the mobile communication device transmitting the selected alert type to the at least one group.

19. The method for transmitting an instant alert using a mobile communication device of claim 17, wherein the selected alert type is transmitted to the at least one group through one or more notification methods selected from the group comprising:

email message, text message, voicemail message, and push notification.

* * * * *